US006990916B1

(12) United States Patent
Atwood, Jr.

(10) Patent No.: US 6,990,916 B1
(45) Date of Patent: Jan. 31, 2006

(54) SAILBOAT MAST STEPPING SYSTEM

(76) Inventor: Rex E. Atwood, Jr., 7 Indian Rock Rd., Nashua, NH (US) 03063

( * ) Notice: Subject to any disclaimer, the term of this patent is extended or adjusted under 35 U.S.C. 154(b) by 0 days.

(21) Appl. No.: 11/011,836

(22) Filed: Dec. 13, 2004

(51) Int. Cl.
*B63B 15/00* (2006.01)

(52) U.S. Cl. ..... 114/91; 114/39.11

(58) Field of Classification Search ..... 114/39.11, 114/39.21, 90, 91, 93
See application file for complete search history.

(56) References Cited

U.S. PATENT DOCUMENTS

| | | | | |
|---|---|---|---|---|
| 270,358 | A | 1/1883 | Aldrich | 114/90 |
| 457,323 | A | 8/1891 | Matthews | 114/91 |
| 477,477 | A | 6/1892 | Uhlig | 114/91 |
| 3,507,240 | A | 4/1970 | Butler | 114/39 |
| 3,678,876 | A | 7/1972 | Alter | 114/102 |
| 3,827,386 | A | 8/1974 | Faden | 114/91 |
| 3,838,655 | A | 10/1974 | Kratz | 114/39 |
| 3,898,948 | A | 8/1975 | Huff | 114/91 |
| 4,042,202 | A | 8/1977 | Molinari | 248/352 |
| 4,112,861 | A | 9/1978 | Lewis | 114/91 |
| 4,194,458 | A | 3/1980 | Messing | 114/39 |
| 4,259,917 | A | 4/1981 | Frank | 114/91 |
| 4,337,714 | A * | 7/1982 | Dougherty | 114/90 |
| 4,448,143 | A | 5/1984 | Welsh | 114/90 |
| 4,624,204 | A | 11/1986 | Temple | 114/91 |
| 4,655,154 | A | 4/1987 | Leonard | 114/91 |
| 5,044,410 | A | 9/1991 | Mix | 114/90 |
| 5,431,121 | A * | 7/1995 | Canepa | 114/39.21 |
| 5,628,266 | A | 5/1997 | Jurriens et al. | 114/39.2 |
| 5,746,151 | A | 5/1998 | Hestehave et al. | 114/343 |
| 5,865,136 | A | 2/1999 | Alexander | 114/91 |
| 2001/0045405 | A1 | 11/2001 | Higgins | 212/231 |
| 2002/0067983 | A1 | 6/2002 | McGill et al. | 414/634 |
| 2002/0070186 | A1 | 6/2002 | Frommelt et al. | 212/196 |
| 2002/0100637 | A1 | 8/2002 | Stringer et al. | 182/148 |
| 2002/0114689 | A1 | 8/2002 | McGill et al. | 414/634 |

FOREIGN PATENT DOCUMENTS

| | | |
|---|---|---|
| DE | 651980 | 1/1936 |
| FR | 2664559 | 1/1992 |
| GB | 580246 | 9/1946 |

* cited by examiner

*Primary Examiner*—Lars A. Olson

(57) ABSTRACT

A sailboat mast stepping system for efficiently using mechanical aids to raise or lower the mast of a sailboat. The sailboat mast stepping system includes a base, a support member substantially housed within the base, a catch member positionable at the end of support member opposite the base and an actuator. Activating the actuator manipulates the support member with respect to the base.

14 Claims, 8 Drawing Sheets

SAILBOAT MAST STEPPING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to mast raising aids and more specifically it relates to a sailboat mast stepping system for efficiently using mechanical aids to raise or lower the mast of a sailboat.

2. Description of the Related Art

Mast raising aids have been in use for years. Typically, sailboats would be of a larger variety that would stay in the water for an entire season or even years at a time without having to remove them from the water and trailer them to storage. Because these larger boats would stay in the water for long periods of time and could be stored next to the water easily, stepping down a mast was rarely done.

In recent years, trailerable cruising sailboats became more common. These types of boats allowed for a person to go sailing on many different lakes or parts of bodies of water that were inaccessible before due to the logistics of moving a sailboat. The difficulty with using these trailerable cruising sailboats was that they are not trailerable without stepping down the mast. Unstepping a mast was a multiple person job and a large chore for a one day sailing excursion.

Another problem aside from trailering was trying to pass under a low bridge while sailing. With the mast stepped up, it was difficult to step the mast down and then step the mast up on the other side of the bridge again.

In these respects, the sailboat mast stepping system according to the present invention substantially departs from the conventional concepts and designs of the prior art, and in so doing provides an apparatus primarily developed for the purpose of efficiently using mechanical aids to raise or lower the mast of a sailboat.

BRIEF SUMMARY OF THE INVENTION

In view of the foregoing disadvantages inherent in the known types of mast raising aids now present in the prior art, the present invention provides a new sailboat mast stepping system construction wherein the same can be utilized for efficiently using mechanical aids to raise or lower the mast of a sailboat.

The general purpose of the present invention, which will be described subsequently in greater detail, is to provide a new sailboat mast stepping system that has many of the advantages of the mast raising aids mentioned heretofore and many novel features that result in a new sailboat mast stepping system which is not anticipated, rendered obvious, suggested, or even implied by any of the prior art mast raising aids, either alone or in any combination thereof.

To attain this, the present invention generally comprises a base, a support member substantially housed within the base, a catch member positionable at the end of the support member opposite the base and an actuator. Activating the actuator manipulates the support member with respect to the base.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a sailboat mast stepping system that will overcome the shortcomings of the prior art devices.

A second object is to provide a sailboat mast stepping system for efficiently using mechanical aids to raise or lower the mast of a sailboat.

Another object is to provide a sailboat mast stepping system that provides support to the mast while it is in a lowered position.

An additional object is to provide a sailboat mast stepping system that is removably attachable to the sailboat.

A further object is to provide a sailboat mast stepping system that is capable of raising and lowering the mast in a relatively short period of time.

Another object is to provide a sailboat mast stepping system that may be stepped and unstepped by a single person.

Yet another object is to provide a sailboat mast stepping system that uses an actuator to aid in raising and lowering a mast.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
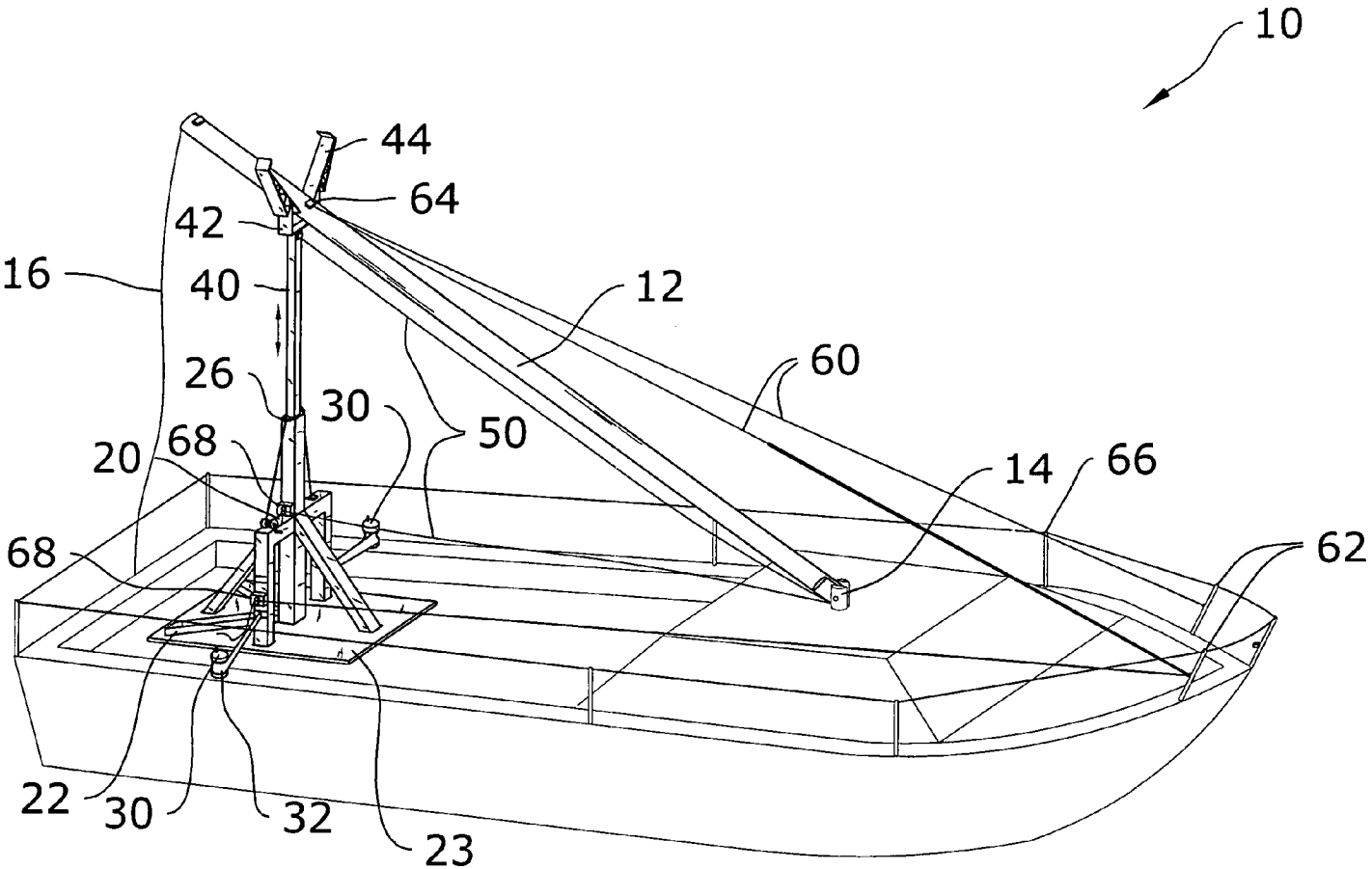
FIG. 1 is an upper perspective view of the present invention illustrating a fully extended support member.
Figure 2:
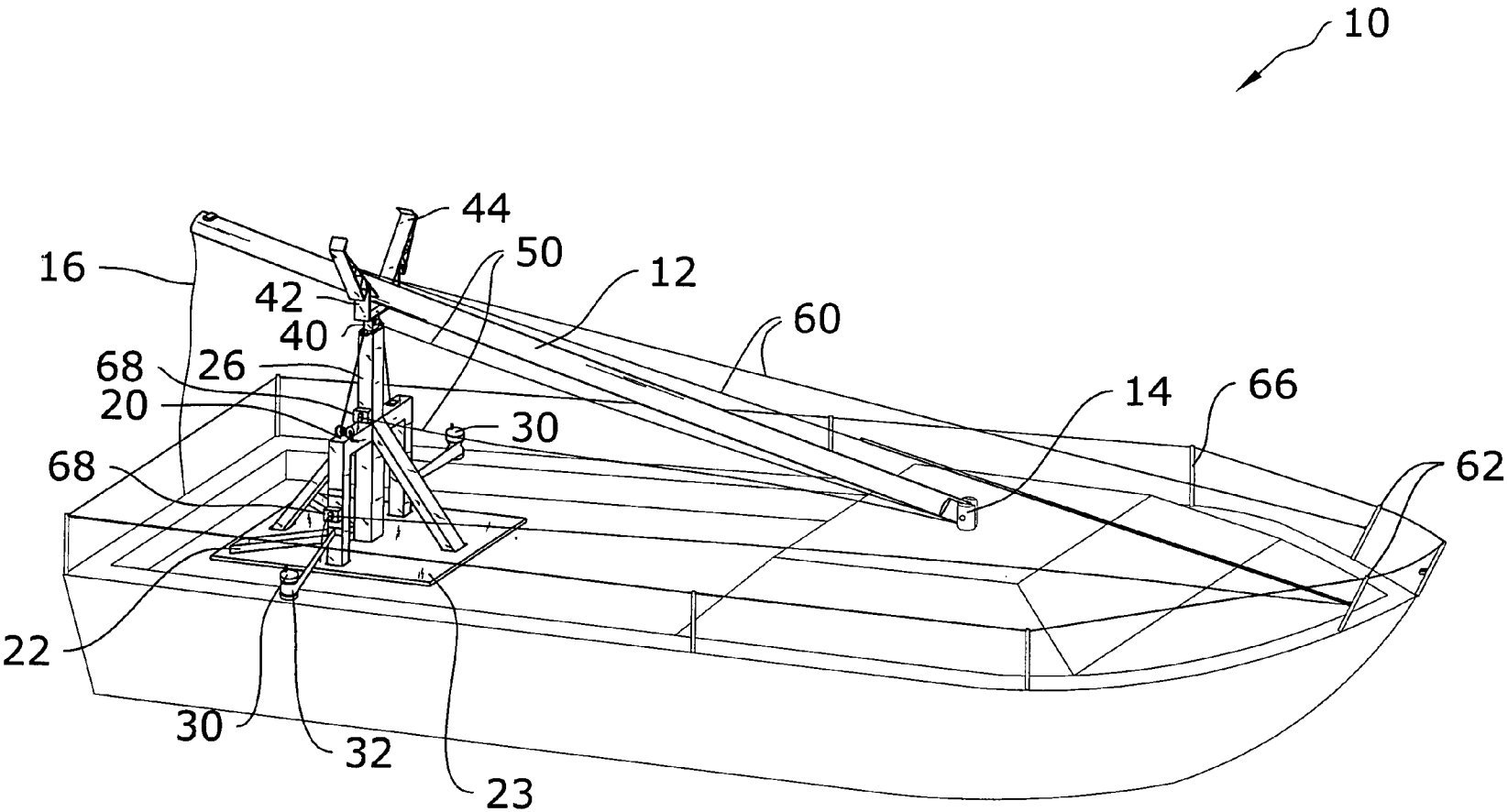
FIG. 2 is an upper perspective view of the present invention illustrating a fully retracted support member.
Figure 3:
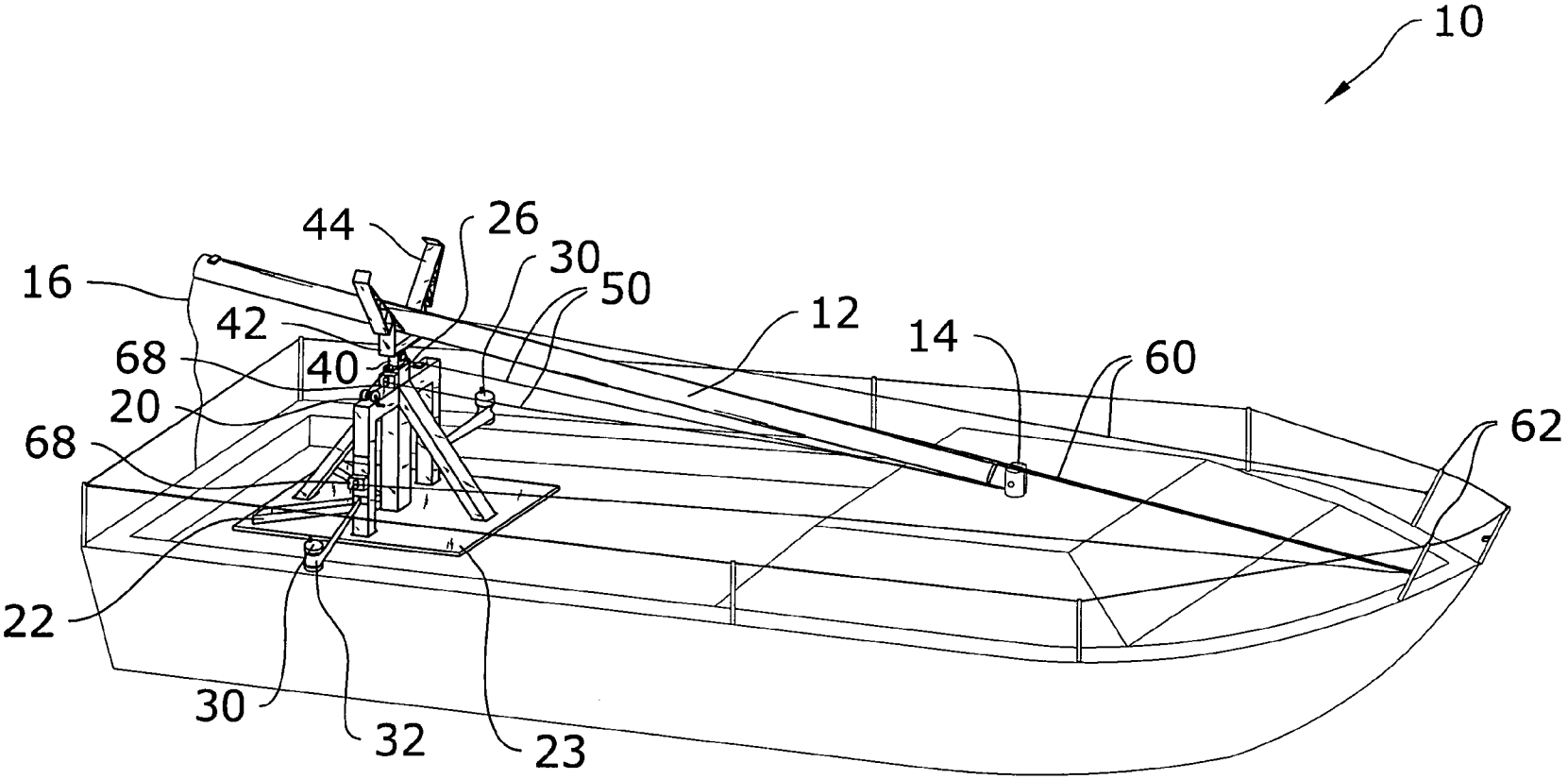
FIG. 3 is an upper perspective view of the present invention illustrating a fully retracted support member.
Figure 4A:
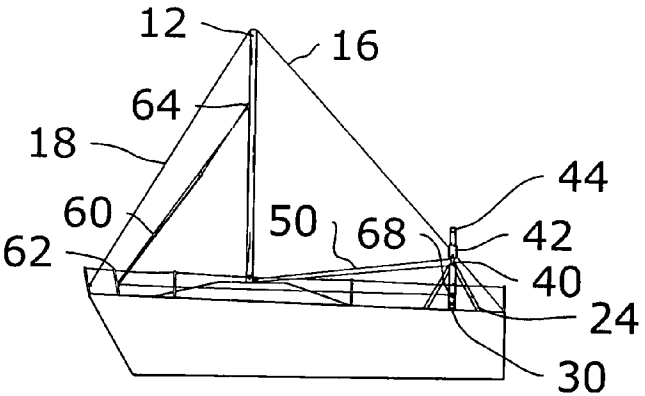
FIG. 4*a* is a side view of the present invention illustrating a mast fully erected and the support member fully retracted.

Turning now descriptively to the drawings, in which similar reference characters denote similar elements throughout the several views, FIGS. 1 through 7 illustrate a sailboat mast stepping system 10, which comprises a base 20, a support member 40 housed substantially within the base 20, a catch member 42 positionable at the end of support member 40 opposite the base 20 and an actuator for raising the support member 40 in a telescoping fashion from the base 20 as shown in FIGS. 3 and 4*a*. Activating the actuator 48 manipulates the support member 40 with respect to the base 20.

A. Base

Figure 5:
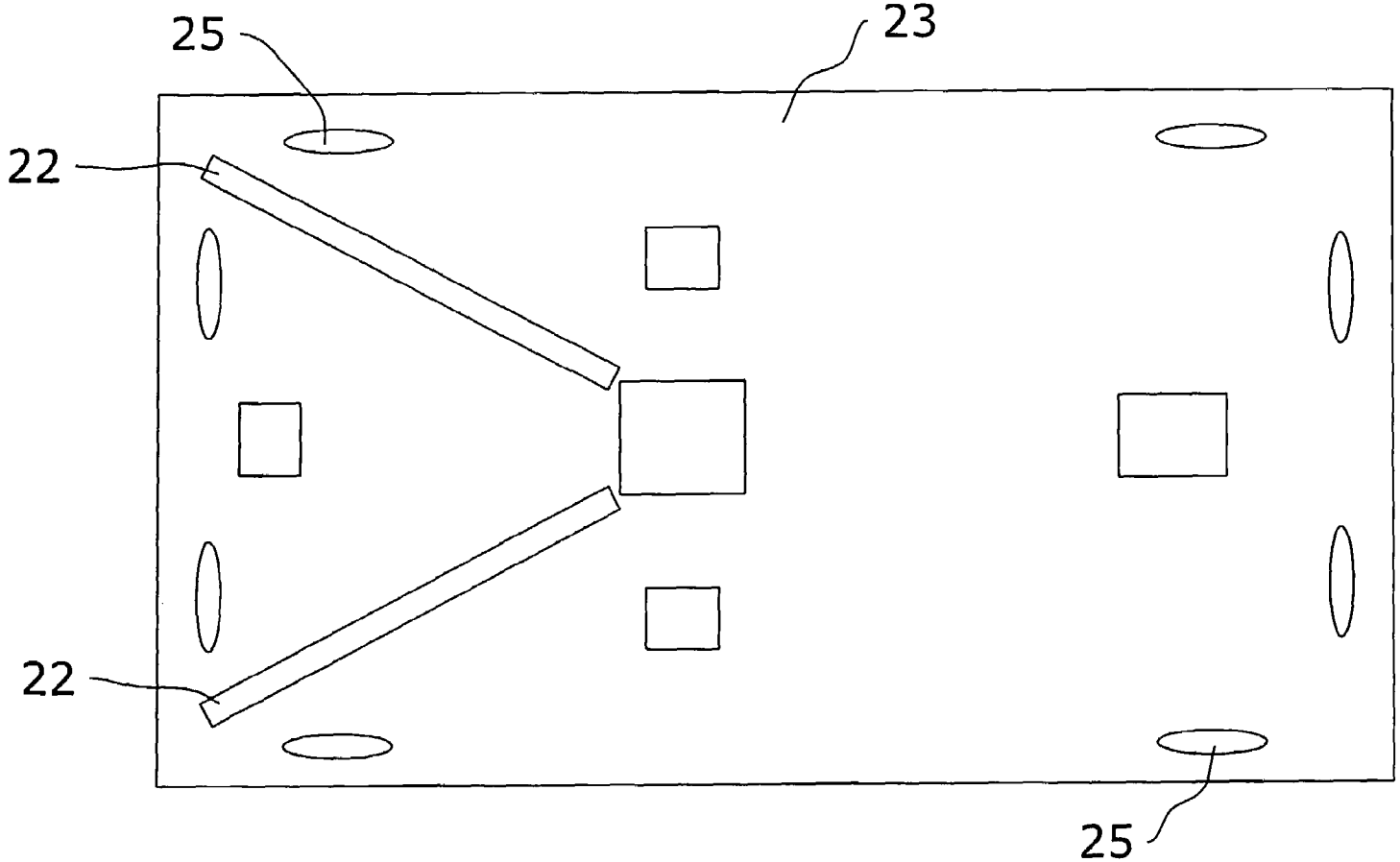
FIG. 5 is a top view of the present invention illustrating the platform handles.

The base 20 is a hollow structure that protrudes substantially transverse to a platform 23. The platform 23 is preferably unsecuredly positioned on the deck of a sailboat as illustrated in FIGS. 1 through 3. A rigid structure is used to construct the base 20. A plurality of handles 25 are positionable around the edges of the platform 23 as shown in FIG. 5.

The base 20 preferably has leg supports 24 extending from the base 20 to the platform 23. Reinforcement arms 22 protrude from the base 20 at the intersection of the base 20 and the platform 23 as illustrated in FIG. 5. The reinforcement arms 23 are preferably secured to the platform 23 along the entire length of each reinforcement arm 23 that protrudes from the base 20 as shown in FIGS. 1 through 3. The base 20 preferably houses the support member 26. The base 20 preferably comes in a variety of lengths and widths thereby providing extra height and/or support when supporting a mast 12 of substantial length or weight.

Figure 6:
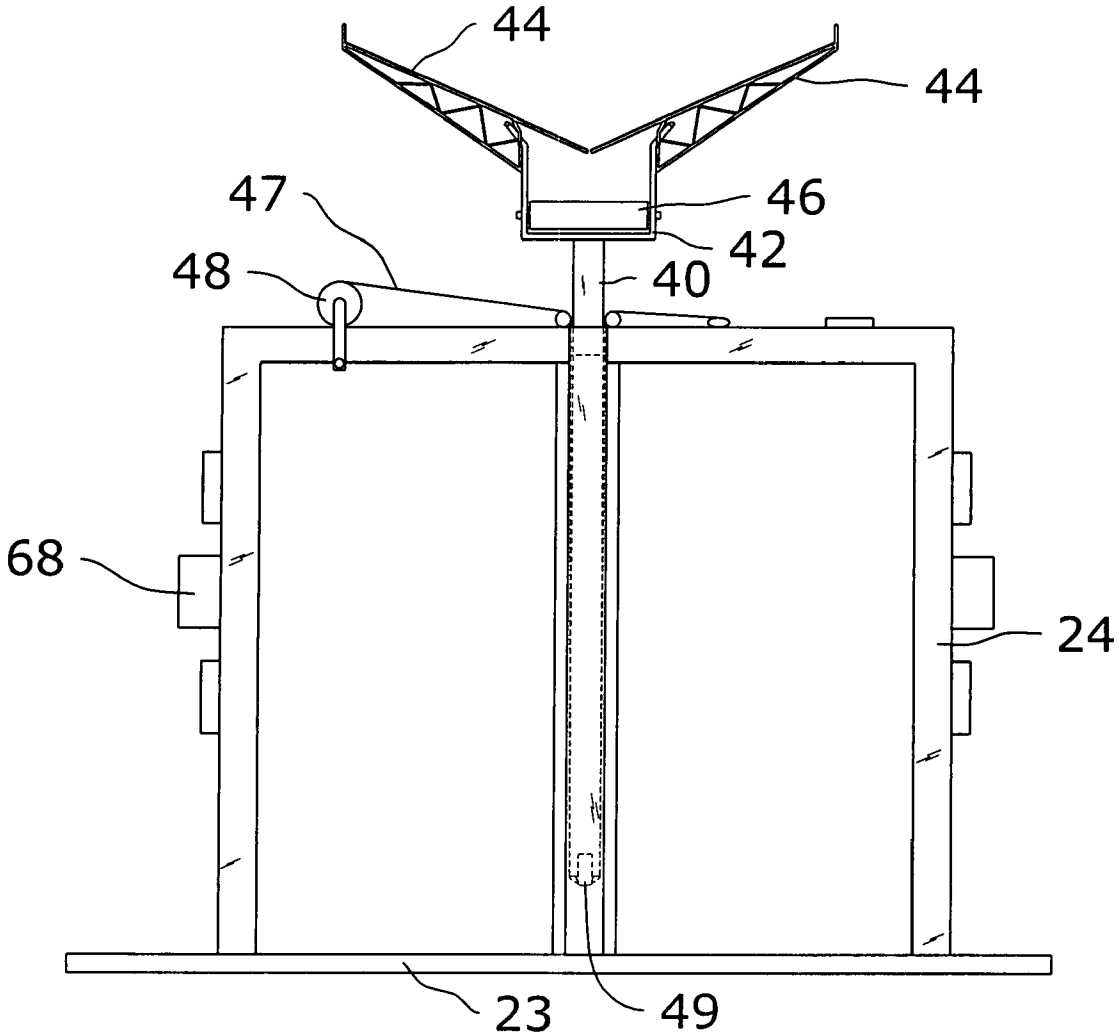
FIG. 6 is a rear view of the present invention illustrating the catch member and catch fingers as unengaged by a mast in an stepped down position.
Figure 7:
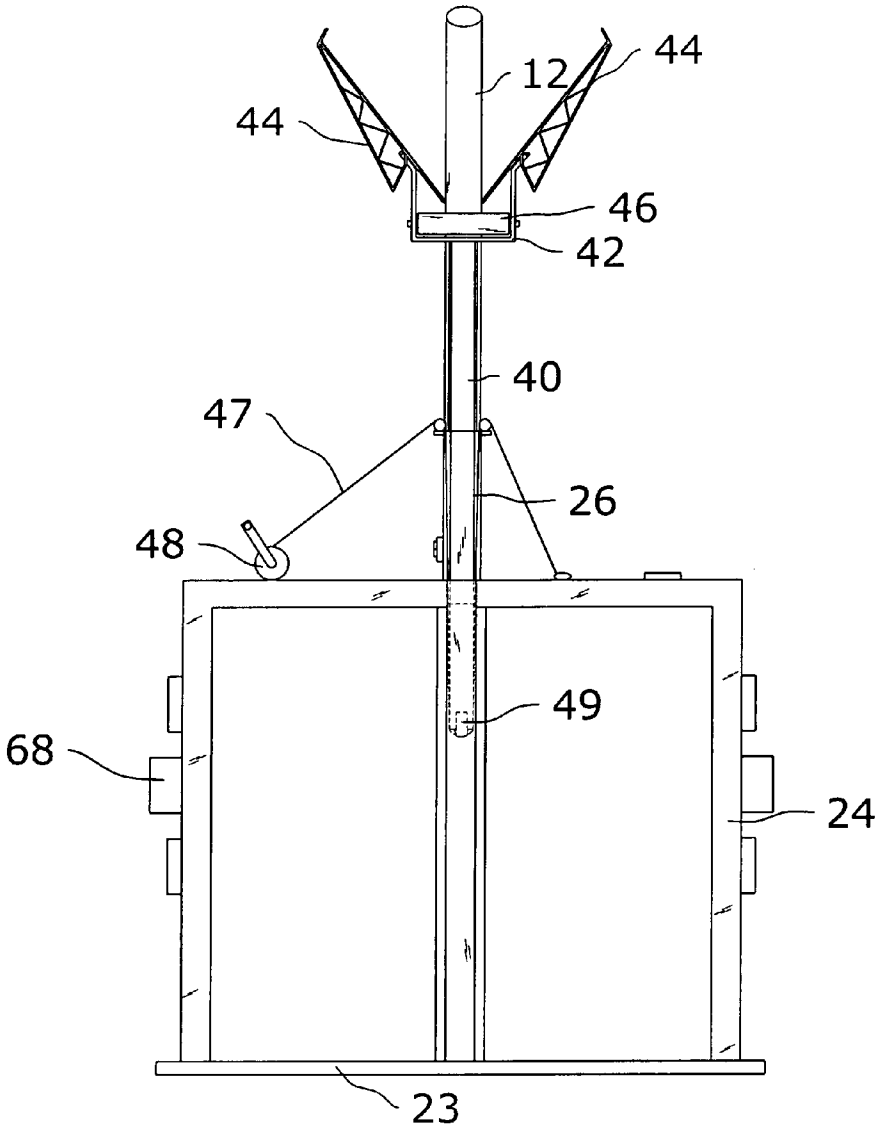
FIG. 7 is a rear view of the present invention illustrating the catch member and catch fingers engaged by a mast in a partially stepped up position.

The support member 40 is positionable within the base 20 as shown in FIGS. 6 and 7. Activation of the actuator 47 manipulates the support member 40 within the base 20. Other structures positionable on the base 20 preferably include the actuator 47, the securing rollers 68 and one end of the first cable 50.

B. Support Member

The width of the support member 40 is sufficiently small enough to fit within the base 20 as show in FIGS. 1 through 3. The support member 40 is constructed of a rigid material capable of supporting the weight of a mast 12. The support member 40 is preferably constructed of various lengths and widths to support a mast 12 of larger length and/or weight.

The actuator 47 manipulates the support member 40 between a fully extended or fully retracted state. The catch member 42 is positionable on an end of the support member 40 opposite the end protruding from the base 20 in a fully extended position as illustrated in FIGS. 1 through 3, 4*b* through 4*d*, 6 and 7. A locking strap 49 is preferably attachable to the end of the support member 40 positioned within the base 20 as shown in FIG. 6. The locking strap 49 is capable of retaining an actuator cable 47 between the locking strap 49 and the support member 40 if the actuator 48 requires an actuator cable 47. The support member 40 may also include a roller positioned between the support member and the actuator cable 47 to ensure a smooth movement of the actuator cable 47 over the end of the support member 40.

C. Catch Member

As shown in FIGS. 1 through 4*e*, 6 and 7, the catch member 42 is positionable on the end of the support member 40 opposite the base 20. The catch member 42 is preferably constructed of a rigid material. The catch member 42 is preferably U-shaped as shown in FIGS. 6 and 7.

Catch fingers 44 are attachable to each of the corners nearest the open end of the U-shaped catch member 42 as shown in FIGS. 6 and 7. A roller 48 extends between the two arms that run substantially parallel within the U-shape. The roller 46 is preferably positionable nearest the end of the catch member 42 opposite of where the catch fingers 44 are positioned.

D. Catch Fingers

The catch members 44 preferably each have one substantially flat surface which is used to engage the mast 12 as shown in FIGS. 6 and 7. These substantially flat surfaces preferably include a barb that protrudes at an angle toward opening that receives the mast 12 and positionable on the distal end of the catch fingers 44 opposite where the catch fingers 44 are attachable to the catch member 42 as shown in FIGS. 6 and 7.

The catch fingers 44 are attachable to the catch members 42 through apertures positionable on the inner edge of the substantially flat side of the catch fingers 44 as shown in FIGS. 6 and 7. The catch fingers 44 are each positionable on the catch member 42 such that each catch finger 44 aligns itself in an open position as shown in FIG. 6. One end of each respective catch finger 44 is in contact with the corresponding end of the opposing catch finger 44, thereby forming a V-shape with an open end of the V-shape for receiving the mast 12 as shown in FIG. 6. The opening of the V-shape is positionable in the same direction as the opening of the preferable U-shape of the catch member 42 as shown in FIG. 6.

E. First Cable

The first cable 60 is preferably made of a material that is flexible, yet able to withstand large pushing and pulling forces exerted upon it. The first cable 60 is also preferably capable of being adjustable along a slidable attachment device 62 without becoming susceptible to snapping or fraying the cable 60.

The first cable 60 is preferably securely attached to a stanchion 66 positionable near the bow of the sailboat as shown in FIGS. 1 through 4*e*. The first cable 60 is thereby extended from the stanchion 66 and slidably attached to a pulley 64 preferably located near the top of the mast 12 as illustrated in FIGS. 1 through 3. From the pulley 64, the first cable 60 is extended to a slidable attachment device 62 on a stanchion 66 positionable near the bow of the sailboat and from the slidable attachment device 62 to securing rollers 68 preferably positionable on a leg support 24 of the base 20 as shown in FIGS. 1 through 3.

The slidable attachment device 62 may include, without limitation, items such as an eyelet or a pulley. The securing rollers 68 are preferably two rollers that receive the first cable 60 between the rollers, whereby each of the securing rollers 68 have a bias force that secures the first cable 60 as it passes between the securing rollers 68. Manipulating the first cable 60 out of the securing rollers 68 allows the first cable 60 to be slidably released through the pulley 64 and slidable attachment device 62, thereby lowering the mast 12.

F. Side Supports

The side supports 30 are preferably positionable on the sides of a sailboat nearest the end opposite the bow, and preferably adjacent to the base 20 and platform 23 as shown in FIGS. 1 through 3. The side supports 30 are preferably attachable to the sailboat so that a support strap 32 may be received by the side supports 30.

The support straps 32 are also attachable to the support legs 24 as illustrated in FIGS. 1 through 3. Because the platform 23 is preferably not attached to the sailboat, attaching the side supports 30 to the support legs 24 via the support straps 32 gives the entire sailboat mast stepping system 10 a higher degree of lateral support to prevent the base 20 from tipping over.

G. Actuator

An actuator 48 is preferably mounted to one of the support legs 24 as shown in FIGS. 6 and 7. FIGS. 6 and 7 illustrate the actuator 48 as a winch, but it can be appreciated that any other actuating means (e.g. hydraulic cylinder, electric actuator, etc.) might be used in place of the winch illustrated.

In FIG. 6, the actuator 48 manipulates an actuator cable 47. The actuator cable 47 is positioned around the end of the support member 40 positioned within the base 20. When a winch is used as an actuator 48, the actuator cable 47 would preferably pass over the end of the support member 40, within the base and out the side of the support member 40 opposite the winch, whereby the actuator cable 47 would be secured back on the base 20.

The actuator 48 preferably manipulates the support member 40 out from within the base 20 or a retraction of the support member 40 back into the base 20. This retraction into or manipulation out of the support member 40 is shown in FIGS. 6 and 7 as using an actuator cable 47 is for the purposes of illustration, but it can be appreciated that any other actuation means may be used to manipulate the support member 40.

H. Stabilizing Line

The stabilizing line 50 is preferably a cable or wire made of a material that is flexible, yet able to withstand large pushing and pulling forces exerted upon it. The stabilizing line 50 preferably also is not susceptible to fraying easily.

The stabilizing line 50 is preferably attachable to a securing roller 68 positionable on a support leg 24 as illustrated in FIG. 6. The stabilizing line 50 is then slidably attachable at the mast pivot 14 as shown in FIGS. 1 through 3. The stabilizing line 50 is thereby preferably attachable to the support member 40 as shown in FIGS. 1 through 4*e*.

The stabilizing line 50 retains the base 20 and the support member 40 in an upright position as the mast 12 is lowered into the catch member 44. The mast 12 is capable of causing the platform 23 to tip over due to the weight and downward pressure associated with receiving the mast 12, thus the stabilizing line 50 provides support to the base 20 with respect to the pivoting force of the mast 12.

I. Operation of Invention

In use, a user desiring to raise the mast 12 from a lowered position begins by making certain all of the cables 16, 60 and lines 50 are attached to their corresponding parts before starting to raise the mast 12 as shown in FIGS. 4*a* through 4*e*. The user activates the actuator 48 to begin the process of raising or stepping up the mast 12. The actuator 48 manipulates the support member 40 to emerge from within the base 20 as illustrated in FIGS. 2 and 7.

Figure 4B:
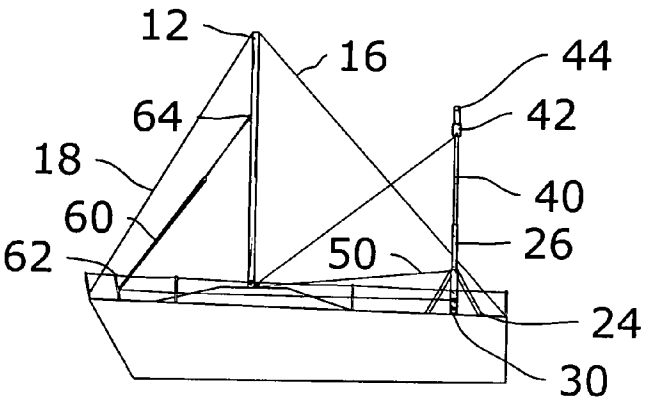
FIG. 4*b* is a side view of the present invention illustrating a mast fully stepped up and the support member fully extended prior to unstepping.

As the support member 40 protrudes from the base 20, the mast 12 begins to pivot about a pivot point 14, and the mast 12 pivots toward being transversely positioned with respect to the deck of the sailboat. The user then pulls the first cable 60 through the securing rollers 68, thereby pivoting the mast 12 about its pivot point 14 to a substantially upright position as shown in FIGS. 4*a* and 4*b*. When the mast 12 has reached a substantially upright position, the second cable 16 prevents the mast from falling forward. The forestay 18 is then attached from the mast 12 to the front of the sailboat, thereby preventing the mast 12 from falling back into the catch member 42 and providing extra support to hold the mast upright 12 as shown in FIGS. 4*a* and 4*b*.

As illustrated in FIG. 4*a*, the user may then retain the sailboat mast stepping system 10 in the same position for subsequent stepping down of the mast 12, or the user may disassemble the sailboat stepping system 10 and remove it from the deck of the sailboat.

Figure 4C:
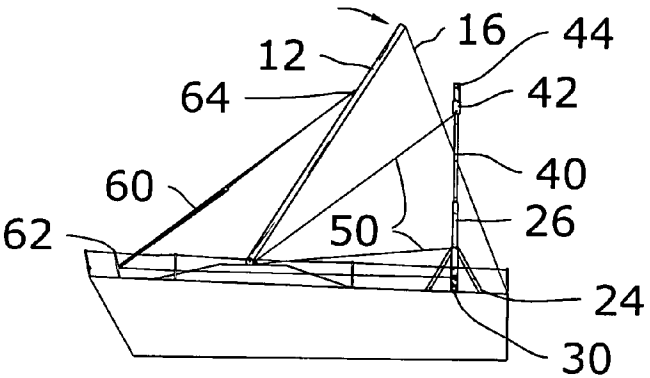
FIG. 4*c* is a side view of the present invention illustrating a mast partially unstepped.
Figure 4E:
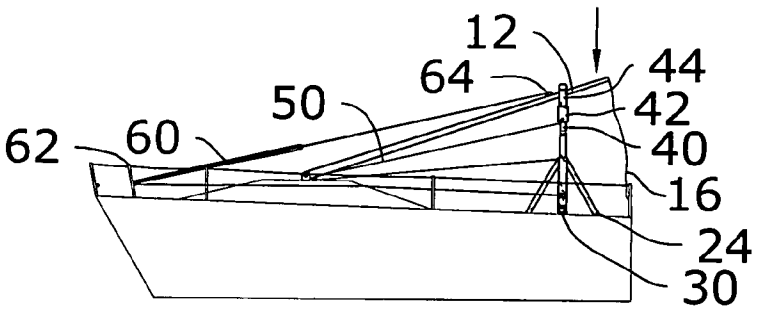
FIG. 4*e* is a side view of the present invention illustrating the mast engaging the catch member in a fully unstepped position.
Figure 4D:
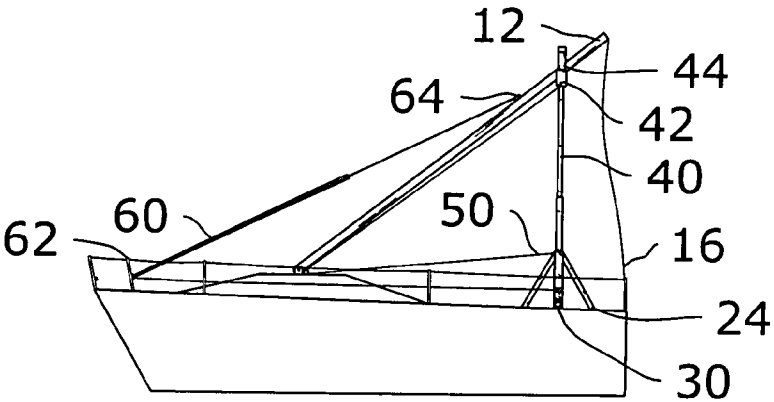
FIG. 4*d* is a side view of the present invention illustrating a mast engaging the catch member in a partially unstepped position.

If the user desired to step down the mast 12, the user would start by loosening the second cable 16 to release any tension in the forestay 18. The user would then detach the forestay 18 from the front of the sailboat. Upon detaching the forestay 18, the user manipulates the first cable 60 out of the securing rollers 68 to release the first cable 60 from the bias force of the securing rollers 68. Releasing a portion of the first cable 60 causes the mast 12 to pivot toward the catch member 42 as shown in FIG. 4*c*. The user then lowers the mast 12 slowly into the opening between the catch fingers 44 and down to the roller 46 of the catch member 42 as shown in FIG. 7. The actuator 48 is then activated to retract the support member 40 back into the base 20 as shown in FIGS. 3 and 4*e*. The rotation of the roller 46 as the mast 12 is stepped down causes the mast 12 to be slidably moved about the roller 46, thereby preventing the catch member 42 from stripping paint off of the mast 12. As the support member 40 becomes fully retracted within the base 20, the user may then remove the side supports 30 and side straps 32 and remove the sailboat mast stepping system 10 from beneath the mast 12. The user may also leave sailboat mast stepping system 10 attached to the sailboat underneath the stepped down mast 12 for future use in stepping up the mast 12 as shown in FIGS. 3 and 4*e*.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A sailboat mast stepping system, comprising:

a base;

a support member extendably positioned within said base;

a catch member attached to said support member, wherein said catch member includes a plurality of catch fingers pivotable with respect to said catch member; and an actuator for manipulating said support member with respect to said base.

2. The sailboat mast stepping system of claim 1, wherein said base includes a platform attached to a lower portion of said base.

3. The sailboat mast stepping system of claim 1, wherein a roller extends between opposing sides of said catch member nearest said support member.

4. The sailboat mast stepping system of claim 1, wherein upon engagement of the mast with a roller, said roller is rotatable with respect to the mast.

5. The sailboat mast stepping system of claim 1, wherein said base is removably positionable on the deck of a sailboat.

6. The sailboat mast stepping system of claim 1, wherein said base includes a lateral support structure comprising:

a plurality of side supports; and a plurality of side straps;

wherein said plurality of side straps extend between said base and said plurality of side supports.

7. The sailboat mast stepping system of claim 1, wherein a plurality of side supports are positioned substantially on opposite sides of said base.

8. A sailboat mast stepping system, comprising:

a base;

a support member extendably positioned within said base; and a catch member attached to said support member, wherein said catch member includes a plurality of catch fingers pivotable with respect to said catch member.

9. The sailboat mast stepping system of claim 8, wherein said base includes a platform attached to a lower portion of said base.

10. The sailboat mast stepping system of claim 8, wherein a roller extends between opposing sides of said catch member nearest said support member.

11. The sailboat mast stepping system of claim 8, wherein upon engagement of the mast with a roller, said roller is rotatable with respect to the mast.

12. The sailboat mast stepping system of claim 8, wherein said base is removably positionable on the deck of a sailboat.

13. The sailboat mast stepping system of claim 8, wherein said base includes a lateral support structure comprising:

a plurality of side supports; and a plurality of side straps;

wherein said plurality of side straps extend between said base and said plurality of side supports.

14. The sailboat mast stepping system of claim 8, wherein a plurality of side supports are positioned substantially on opposite sides of said base.

* * * * *